United States Patent [19]

Hagerty et al.

[11] 4,285,602

[45] Aug. 25, 1981

[54] METHOD AND APPARATUS FOR THE BLENDING OF GRANULAR MATERIALS

[75] Inventors: Robert O. Hagerty, Bound Brook, N.J.; Jannan G. Lee, Houston, Tex.; Kenneth C. Yi, Belle Mead, N.J.

[73] Assignee: Union Carbide Corporation, New York, N.Y.

[21] Appl. No.: 82,471

[22] Filed: Oct. 9, 1979

Related U.S. Application Data

[63] Continuation-in-part of Ser. No. 38,738, May 14, 1979, abandoned.

[51] Int. Cl.[3] ..... B01F 15/02

[52] U.S. Cl. ..... 366/177; 366/101; 366/137; 366/341

[58] Field of Search ..... 366/101, 136, 137, 106, 366/107, 134, 177, 341, 140, 184, 191

[56] References Cited

U.S. PATENT DOCUMENTS

| | | | |
|---|---|---|---|
| 3,138,369 | 6/1964 | Bennett | 366/136 |
| 3,158,362 | 11/1964 | Seifarth | 366/134 |
| 3,268,215 | 8/1966 | Burton | 366/177 |
| 3,275,303 | 9/1966 | Goins | 366/137 |
| 3,351,326 | 11/1967 | Alberts | 366/101 |

*Primary Examiner*—Robert W. Jenkins
*Attorney, Agent, or Firm*—Clement J. Vicari

[57] ABSTRACT

Gravity flow blending system for granular materials by use of novel internal handling means which provides for a continuous, uniform withdrawal of material from a multitude of locations in a large capacity bin. The invention utilizes basic principles of solids rheology to provide for a natural internal self-regulation which makes it possible to use this system for a wide range of material discharge rates and granular material types.

4 Claims, 7 Drawing Figures

METHOD AND APPARATUS FOR THE BLENDING OF GRANULAR MATERIALS

This is a continuation-in-part of our prior copending application Ser. No. 038738 filed May 14, 1979 and entitled "Method and Apparatus for the Blending of Granular Materials", now abandoned.

The present invention relates to a method and apparatus for blending freely-flowing granular materials contained within a hoppered bin. Operation may be in either a continuous mode with the simultaneous loading and discharge of material (with a predetermined material volume maintained in the bin) or in a batch mode with consecutive loading and discharge.

The blending operation is accomplished by withdrawing material by gravity flow from a multitude of locations distributed essentially uniformly within the designated blending region of the bin. The blending region may be the whole or merely part of the total bin volume depending on the application.

In accordance with the present invention, a method is provided for the high efficiency blending of solid particulate materials which comprises: introducing the materials to be mixed into a bin; withdrawing one portion of said solid particulate materials by gravity through downwardly-extending main blending tube means having positioned through the walls thereof, a plurality of material inlet passages positioned and dimensioned to provide unblocked or starved flow characteristics therethrough; withdrawing another portion of said solid particulate materials by gravity through a plurality of downwardly extending auxiliary blending tube means having positioned, through the walls thereof, a plurality of material inlet passages positioned and dimensioned to provide blocked flow characteristics therethrough; joining the portions of material in an enlarged section near the downstream ends all of said main blending tube and auxiliary blending tube means which joined portions of material are passed therefrom as a blended stream; and maintaining unblocked or starved flow characteristics in said main blending tube while maintaining blocked flow characteristics in said plurality of auxiliary blending tubes.

Apparatus suitable for use in carrying out the method aspect of the invention is as set forth in the embodiment of the drawings in which.

Figure 1:
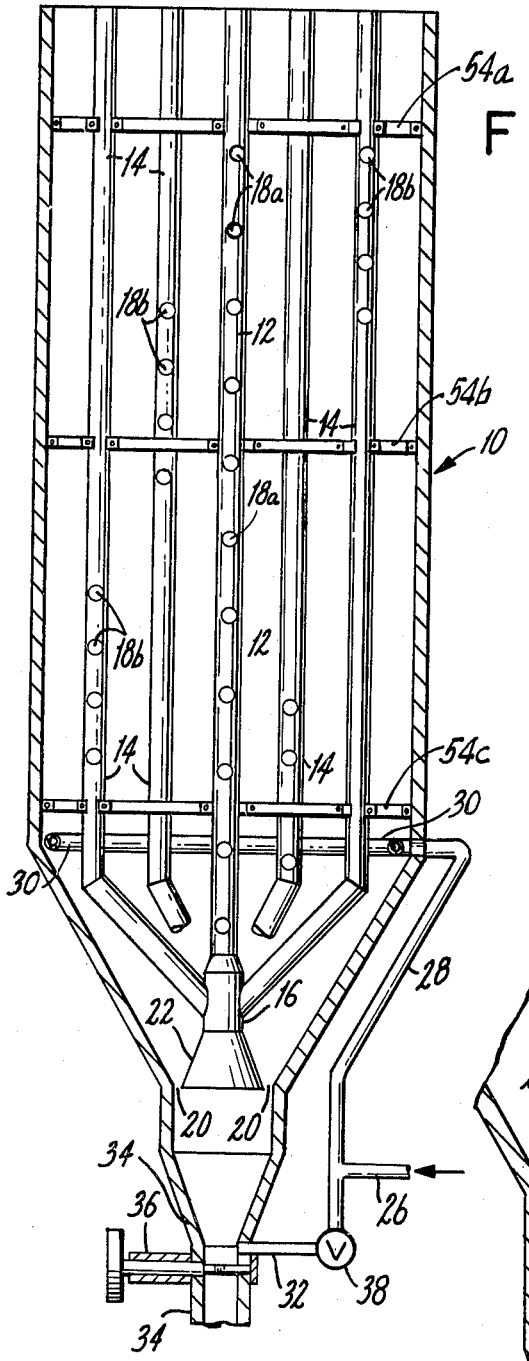
FIG. 1 is a vertical cross-sectional view of the hoppered bin apparatus.
Figure 2:
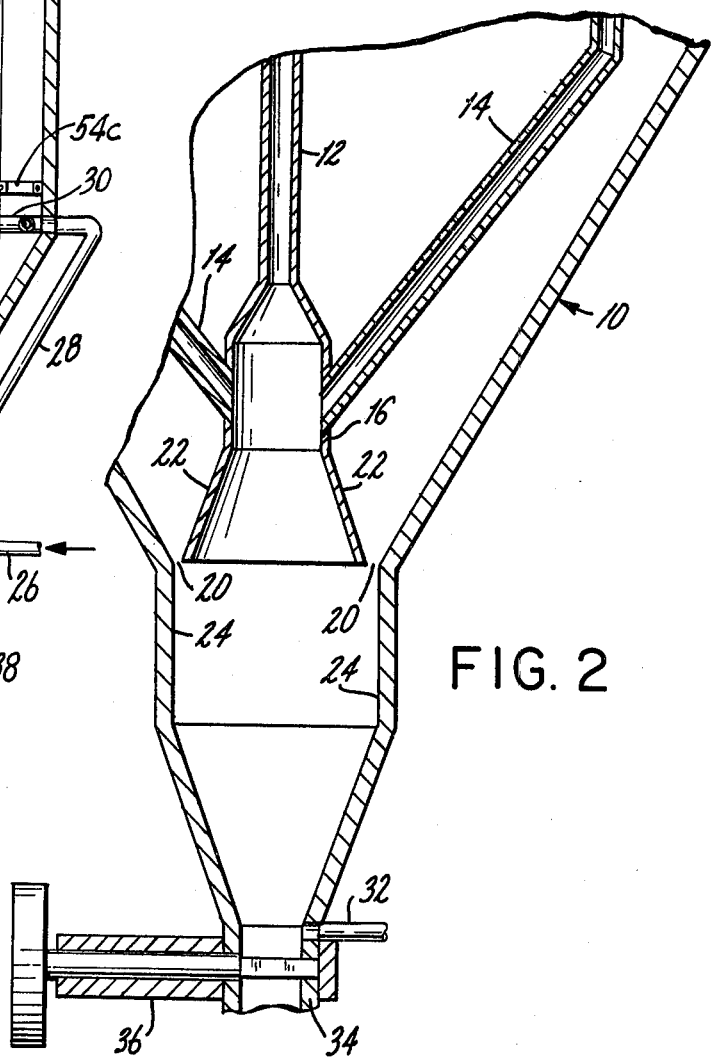
FIG. 2 is an enlarged fragmentary view of the hoppered bin of FIG. 1 showing, in greater internal sectional detail, the lower end thereof.

As shown in the embodiment of FIGS. 1 and 2 of the drawings, the apparatus comprises a hoppered bin 10 having a main blending tube 12 and a plurality of auxiliary blending tubes 14 which join into an enlarged section 16 below the main tube 12. Holes or passages **18*a* and 18*b* respectively pass through the tube walls of the main and auxiliary blending tubes 12 and 14. The blending tubes are positioned to allow the granular material to flow into the tube interiors wherein it flows downward toward the discharge outlet at the lower section of the hoppered bin or blender 10**. The material outlet flow rate is controlled by setting of valve means positioned at the downstream end of the blender.

The passages or holes **18*a* of the main tube are typically distributed uniformly over its length and are sized so that, for the minimum discharge rate and the fastest flowing granular material to be blended, these holes can provide only, for example, 75 percent of the discharge rate. That is, the main blending tube 12 should always be "starved" or unblocked. The additional material required for the minimum and higher discharge rates is provided by the combination of "hopper flow" of material through the annular space 20 around the blending skirt 22 and flow of material through passages or holes 18*b* of and through the auxiliary blending tubes 14**.

Open or closed blender embodiments may be alternatively employed within the scope of the present invention depending upon the use to which the blender is to be put. Continuous operation would favor an open blender (open at the top to the atmosphere and enabling continuous filling), but closed continuous operation blenders, as described hereinbelow, may also be employed. It has been found that the closed embodiment is the most preferred embodiment for all operations of the blender of the present invention. Such a closed top blender provides shelter from the admission of foreign matter into the hopper blender bin as well as a means for providing additional structural support for the internal blending tube assembly.

The flow rate of material into the enlarged section 16 of the main tube 12 from the auxiliary tube 14 is self-regulated so that, for a larger than minimum discharge rate, the additional material required is automatically provided.

It has been found that "blocked" auxiliary blending tubes provide for the self-regulation of material flow rates at auxiliary tubes. In order to obtain "blocked-flow characteristics" in the auxiliary tubes of the blenders of the invention this self-regulation effect is needed. It has been found that the enlarged section inner cross-sectional area at the discharge section of the tubes should be substantially equal to or larger than the combined auxiliary blending areas at the points of junction with the enlarged section. The self-regulation effect, described above, is provided by satisfying the unity or greater ratio between the enlarged section cross-sectional area and the combined auxiliary blending junction tube areas at the points of junction with the enlarged section.

If the discharge rate is less than the maximum combined flow rates of the hopper and the main and auxiliary blending tubes, then a densely-packed but flowing region will build up in the enlarged section until the auxiliary tube openings are almost completely blocked. This densely-packed region acts as a throttle for the auxiliary tube flow, preventing the tubes from flowing at their maximum rates. It is in this context that the auxiliary tube is said to be exhibiting "blocked flow characteristics". If the discharge rate were to increase, then the height of the densely-packed region would drop and the auxiliary tube flowrate would increase. (The opposite applies for a decrease in discharge rate.)

Employing a blender having an unblocked main blending tube and a plurality of blocked auxiliary blending tubes communicating with the outlet of the main tubes in the manner shown in FIG. 2 of the drawings, it has been found that, for operation with bin material level above the metering holes of all the auxiliary tubes, each auxiliary tube provides a generally equal contribution to the total material passed through all the auxiliary tubes.

Since the auxiliary blending tubes 14 are required to feed material over a wide range of flow rates, these tubes do not operate in a "starved" manner. If a blending tube is discharging material at a lower rate than is possible with the given number of material inlet metering passages or holes, then a region of densely-packed but flowing material will build up in the tube so that the appropriate number of lower holes are closed by the presence of the densely-packed region and, therefore, are not feeding. Holes located above the upper level of densely-packed material can feed freely.

As shown in the embodiment of the drawing, each auxiliary blending tube 14 has a multitude of passages or holes which are distributed over only a part of the vertical expanse of the blending region. The combination of upper feeding holes of all the auxiliary tubes are intended to be essentially uniformly distributed over the blending region regardless of the total discharge rate. Whereas, for purposes of illustration in connection with the description of the continuous mode of operation, metering holes have been shown at only specific portions of the auxiliary tubes of the embodiment of blender shown in FIG. 1 of the drawings. It is to be understood that for both continuous and batch operation modes such holes may extend up to substantially the entire length of such auxiliary tubes.

A multiplicity of auxiliary tubes (three or more) is used in the embodiment of the drawing so that the upper flow from all of the auxiliary tubes combined will approximate the desired uniform withdrawal from the blending region. The greater the number of auxiliary tubes, the closer the approximation to the ideal case of perfecting uniform withdrawal. However, because a number of holes in each auxiliary blending tube will be feeding material for even the minimum discharge rate, a relatively small number of tubes are needed to match the performance of previously known gravity blending systems with many more blending tubes. This naturally effects a considerable cost reduction.

A small amount of material flow from around the blending skirt 22 into the discharge outlet is most preferably maintained at all times to prevent a non-flowing condition in the lower section of the bin. As shown in FIG. 2, the bottom of the main blending tube 12 consists of a conical section (blending tube flare) 22, the bottom of which partially spans the cylindrical section 24 of the outlet hopper. This hopper is designed to provide a "mass flow" with approximately constant material flow velocity across its cross-section. Flow into the outlet hopper 24 will come from both the combined blending tubes and the annular gap 20 between the blending tube flare and the inner hopper walls. The ratio of the two flow rates has been found to be approximately equal to the ratio of the annual gap area to that of the blending tube flare. The provision of such a lower section insures that a constant fraction (typically about 12 percent) of the total material flow represents material discharged from the bottom of the main hopper for all discharge rates. The cross-sectional area of the downstream outlet hopper region is greater than that of the enlarged section 16.

During a batch mode of discharge operation, the material level in the blender will be decreasing. Material metering holes or passages located above the material level become inoperative and it is necessary to provide additional feeding holes which become active only when the material level is lowered. These holes are distributed on the auxiliary blending tubes in such a way that, regardless of the level, material is withdrawn in an approximately uniform manner from the region of the bin containing material. During a continuous mode of operation a constant, predetermined volume of material is in the blender and the additional holes are prevented from feeding by the densely-packed material in the auxiliary blending tubes.

The blender described herein can also be employed with a purging operation as shown in FIG. 2 of the drawing. Such an operation is required if flammable gases tend to evolve from the granular material (e.g., low density polyethylene pellets). By maintaining an air flow through the blender, these gases can be expelled, preventing a combustible mixture from accumulating in the hopper bin.

As shown, the purging gas, such as air, is introduced through inlet conduit 26 and, in turn, the purge inlet line 28 to the purge gas distributor 30 positioned within the hopper bin 10. An additional purge gas line 32 is positioned in the material outlet line 34 immediately upstream of the material outlet sliding gate valve 36. A purge gas valve 38 is positioned in the additional purge gas line 32 and is preferentially maintained open for ititial filling only while material outlet valve 36 is closed.

Figure 3:
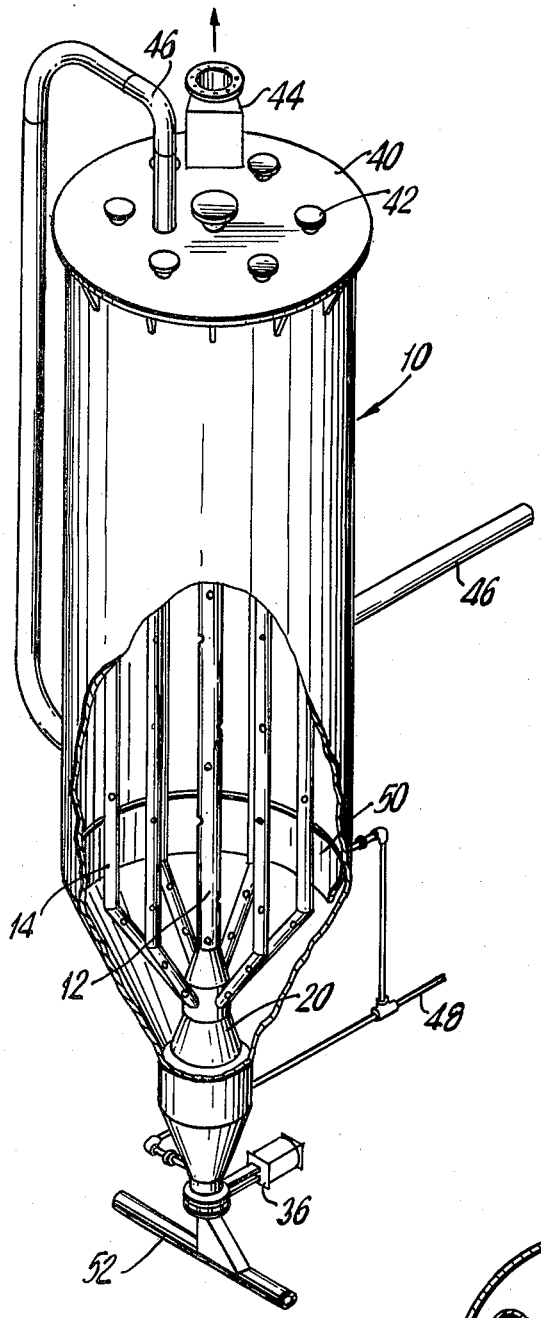
FIG. 3 is a perspective view of a closed hoppered bin apparatus of the embodiment of FIGS. 1 and 2.

The entire blending apparatus of the invention is shown schematically in FIG. 3 of the drawings. The embodiment there shown is a closed blender having a top cover 40 and tube access port closures 42 positioned therein. A dust collector outlet port member 44 is also secured to the top closure 40 as is the entry of resin inlet through resin inlet tube 46. The main blending tube 12 and the six auxiliary blending tubes 14 are also shown as positioned in the interior of the blender body 10. All blending tubes terminate in the enlarged section 22 at the base of the blender. Purge air entering through inlet line 48 passes to both the purge air distributor 50 within the blender body 10 and the lower section of the outlet of the blender. Also positioned as shown in FIG. 3 are the outlet slide valve 36 and outlet blender resin line 52.

Figure 4:
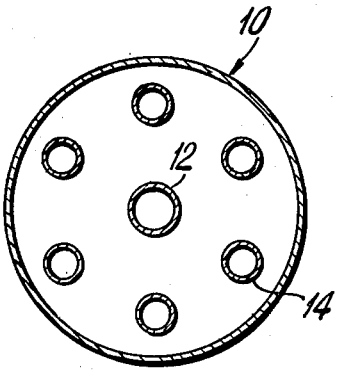
FIG. 4 is a schematic top sectional view of the hoppered bin apparatus showing the internal relationship of the main and auxiliary blending tubes.

As shown in FIG. 4 of the drawings, the six auxiliary blending tubes 14 are positioned around the main blending tube 12 within blender body 10.

Figure 5:
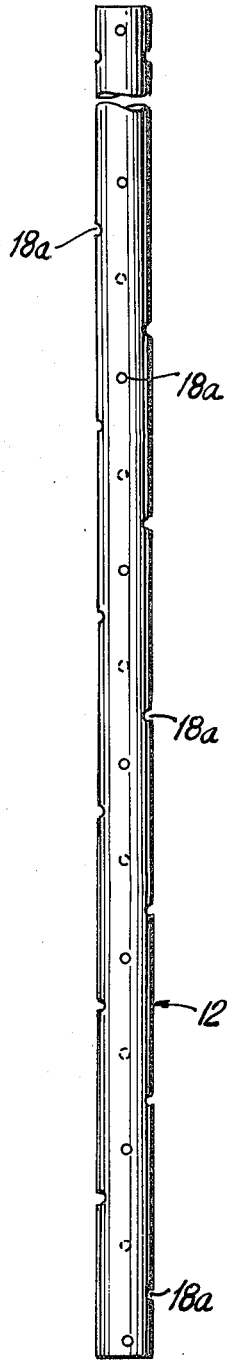
FIG. 5 is a partial elevational view of the main blending tube of the hoppered bin apparatus, showing the orientation of holes through the tube walls.
Figure 6:
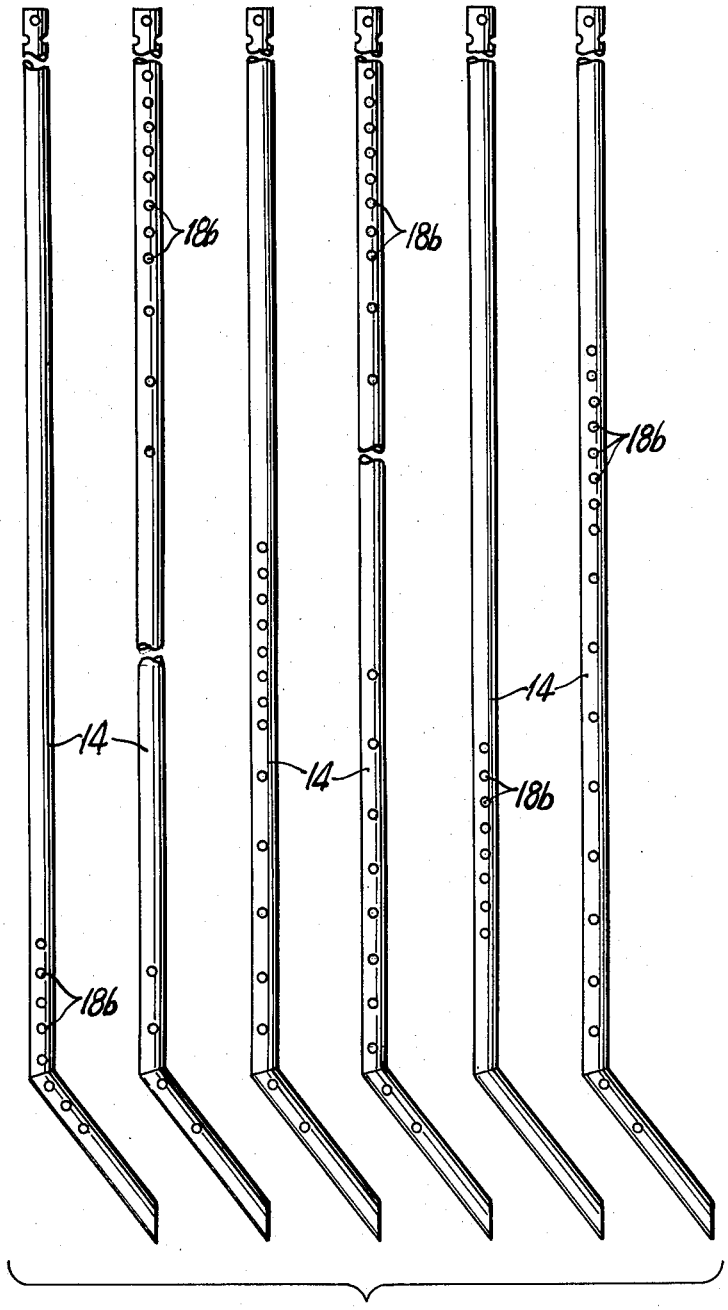
FIG. 6 is an exploded schematic view of the six auxiliary blending tubes laid out so as to show the relative orientation of holes in the tube walls.

FIG. 5 of the drawings shows the main blending tube 12 and the orientation of the main blending tube holes 18*a*, successively positioned at 90° from each other along the length of the main blending tube. An exploded view showing of the six auxiliary blending tubes 14 appears in FIG. 6 of the drawings, together with a preferred relative positioning arrangement for the auxiliary blending tube holes 18*b*.

Figure 7:
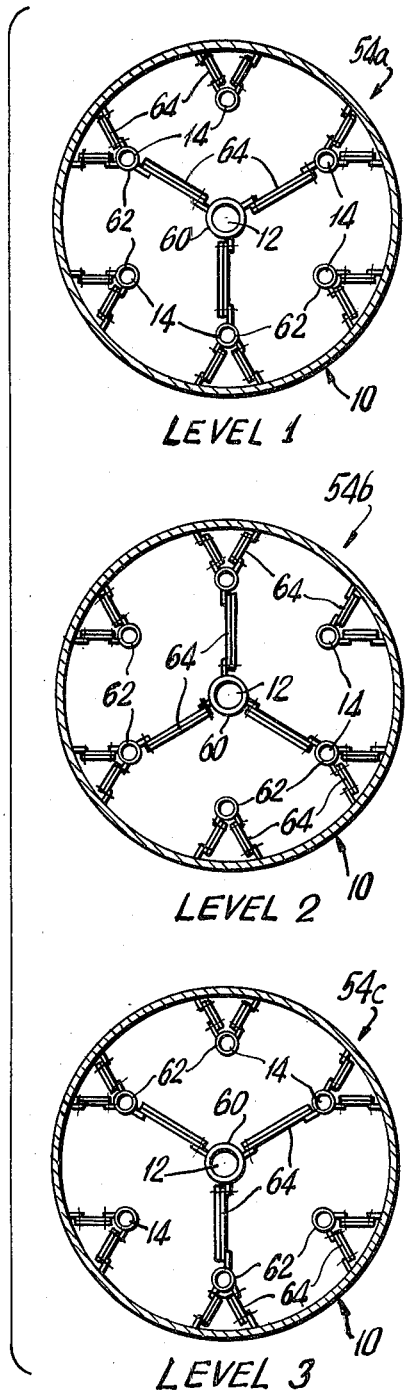
FIG. 7 is an exploded schematic view of the three blending tube support assemblies positioned at different levels within the hoppered bin, as shown in FIG. 1 hereof.

The blender of the embodiment of the figures of the drawings is such that the preferred manner of suspension of the main and auxiliary blending tubes is shown as a triple level assembly of supporting members designated as 54a, 54b and 54c in FIGS. 1 and 7. As shown in greater detail in FIG. 7, levels 1, 2 and 3 show these assemblies within the outer blender wall 10. Level 1 and level 3 are substantially identical, with level 2 providing the alternate of pair support for levels 1 and 3. Each level support assembly encloses the main blending tube 12 and the auxiliary blending tubes 14 by respective supporting enclosure within outer sleeve members 60 and 62, respectively. These outer sleeve members are, in turn, connected through support members 64 to either of the sleeve members or the blender walls as shown in the three levels of FIG. 7.

The method and apparatus of the invention can be employed to effect the blending of any solid granular materials. They are particularly well suited to the blending of materials of thermoplastic resin (such as low density polyethylene, high density polyethylene and the like). Blenders of this type exhibit high blending efficiency and high throughput capacity (i.e. greater than 40,000 pounds per hour) in the handling of polyethylene granular materials.

In an example of the practice of the invention, blending apparatus was constructed capable of providing adjustable material transfer rates (throughput capacity) of between 15,000 and 40,000 pounds/hour of granular polyethylene material. This blending apparatus was of the general design as shown in the embodiment of the figures of the drawings. This blender is capable of handling a wide variety of granular materials, such as both low and high density granular polyethylene resins.

The total volume of the blender was 13,000 cubic feet which provided a 7,000 cubic foot blending volume (the predetermined minimum material volume maintained during continuous mode blending). The outer bin shell of the blender was constructed of 5052-H32 aluminum alloy of 16 feet inside diameter and approximately 60 feet in height of the cylindrical section with a bottom hopper angle of 60° from the horizontal.

The outlet hopper insert below the main hopper was constructed of similar aluminum alloy, has a 39 inch inside diameter, 30 inch height of the cylindrical section and a hopper angle of 70° from the horizontal. The outlet of the hopper was 12 inches in inside diameter.

The main blending tube comprised 8-inch 6061-T6 aluminum alloy pipe of length sufficient to extend to the top of the bin. Thirty-four main blending tube holes, each having a diameter of $1\frac{3}{8}$ inches and distributed uniformly over the blending region, were provided. The holes were drilled perpendicular to the tube center line and deburred. Two holes were positioned in each elevation spaced 180° apart. The hole pairs were positioned with a 90° rotation from those of the preceding elevation position.

The auxiliary blending tubes were six in number, each composed of 6061-T6 aluminum alloy pipes having a 6-inch diameter and of length sufficient to extend to the top of the bin. Each of the auxiliary blending tubes had a group of from 16 to 48 holes of $1\frac{3}{8}$ inch diameter which were relatively positioned in a hole pattern similar to that employed in the main blending tube.

The purge air flow rate of 250 SCFM is provided to be maintained at all times.

The minimum discharge rate for the operation of the blender employing high density polyethylene material is 15,000 pounds per hour, with a calculated 10,540 pounds per hour flowing through the main tube, 2435 pounds per hour flowing through the combined auxiliary tubes and 2025 pounds per hour flowing through the annular gap 20 between the blending tube flare and the hopper bin walls.

The maximum discharge rate is 40,000 pounds per hour with a calculated 10,540 pounds per hour passing through the main tube, 24,060 pounds per hour through the combined auxiliary tubes and 5400 pounds per hour passing through the annular gap. The annular gap flow is always a fixed percentage of the total output, but the main blending tube flows a constant rate of material and the aggregate auxiliary blending tubes flow a self-regulated output to provide the additional material required.

In this embodiment, four holes of $1\frac{1}{2}$ inch diameter were positioned near the top of all seven blending tubes, below the blender roof and well above the maximum resin level, to provide for equalization of pressure within the tubes.

It is, of course, well understood to those skilled in the solid material blending art that the parameters of the elements of apparatus of the invention are to be dimensioned to effect most preferred results for various materials, including the volume to be handled and flow rates most preferred from the standpoint of the blending operation.

What is claimed is:

1. A method for the high efficiency blending of solid particulate materials which comprises: introducing the materials to be mixed into a bin; withdrawing one portion of said solid particulate materials by gravity through downwardly-extending main blending tube means having positioned, through the walls thereof, a plurality of material inlet passages positioned and dimensioned to provide unblocked or starved flow characteristics therethrough; withdrawing another portion of said solid particulate materials by gravity through a plurality of downwardly extending auxiliary blending tube means having positioned, through the walls thereof, a plurality of material inlet passages positioned and dimensioned to provide blocked flow characteristics therethrough; joining the portions of material in an enlarged section near the downstream ends all of said main blending tube and auxiliary blending tube means which joined portions of material are passed therefrom as a blended stream; and maintaining unblocked or starved flow characteristics in said main blending tube means while maintaining blocked flow characteristics in said plurality of auxiliary blending tube means.

2. The method in accordance with claim 1, wherein a portion of said materials is passed by gravity as an outer annular stream between said enlarged section and the walls of said bin to a downstream region where it further blends with said blended stream.

3. Apparatus for the high efficiency blending of solid particulate materials which comprises: an outer hoppered bin having means for the introduction thereinto of materials to be mixed; downwardly-extending main blending tube means positioned therein and having passing through the walls thereof a plurality of material inlet passages positioned and dimensioned to provide unblocked or starved flow characteristics therethrough; a plurality of downwardly-extending auxiliary blending tube means positioned in said bin and having passing through the walls thereof a plurality of material inlet passages positioned and dimensioned to provide blocked flow characteristics therethrough; said main and said auxiliary blending tube means joining in an enlarged section near their downstream ends to pass a blended stream of material flow while maintaining unblocked or starved flow characteristics in said main blending tube means and blocked flow characteristics in said plurality of auxiliary blending tube means.

4. The apparatus as defined in claim 3, wherein said hoppered bin provides an outer annular passage of hoppered material flow around said enlarged section which flow is joined with said blended stream of flow at downstream region of final blending in a zone having a larger cross-sectional area than said enlarged section.

* * * * *